US006419285B1

(12) United States Patent
Wu

(10) Patent No.: US 6,419,285 B1
(45) Date of Patent: Jul. 16, 2002

(54) TRANSMISSION ASSEMBLY OF A LOCK

(76) Inventor: Danny Ko Tun Wu, No. 12, Chien-San Rd., Chungho City, Taipei Hsien (TW)

( * ) Notice: Subject to any disclaimer, the term of this patent is extended or adjusted under 35 U.S.C. 154(b) by 0 days.

(21) Appl. No.: 09/757,275

(22) Filed: Jan. 8, 2001

(51) Int. Cl.[7] ..... E05C 1/06
(52) U.S. Cl. ..... 292/140; 292/138; 70/379 R
(58) Field of Search ..... 70/379 R, 320; 292/138, 140, 37

(56) References Cited

U.S. PATENT DOCUMENTS 4,656,850 A * 4/1987 Tabata ..... 70/276
4,683,733 A * 8/1987 Marin ..... 70/134
5,199,288 A * 4/1993 Meriläinen et al. ..... 70/279
5,339,663 A * 8/1994 Döring ..... 70/379 R

* cited by examiner

*Primary Examiner*—Teri Pham Luu
(74) *Attorney, Agent, or Firm*—Dellett and Walters

(57) ABSTRACT

A transmission assembly for a lock has a p i pivotally engaged with the latch and a disk rotatably mounted onto the latch and engaged with a side face of the push plate. With the abutment of the push plate to an inner face of a casing of the lock, the latch is able to move evenly inward the casing when the lock is changing from a lock mode to an unlock mode.

7 Claims, 4 Drawing Sheets

TRANSMISSION ASSEMBLY OF A LOCK

BACKGROUND OF THE INVENTION

1. Field of the Invention

The present invention relates to a transmission assembly of a lock, and more particularly to a transmission device having a push plate pivotally connected with a latch, a disk rotatably engaged with the push plate and securely mounted on the latch. With the rotational movement of a deadbolt, the corresponding travel of the latch will drive the push plate to abut the disk that is mounted on the latch and is opposite in relation to a pivot hole for the push plate. The combination of the push plate and the disk enables the latch to extend to an outermost position smoothly.

2. Description of Related Art

The existing lock normally has a major problem that is either the latch is not able to extend farther away from the lock assembly to have a better effect in locking or the latch is not able to extend or retract from the lock assembly smoothly. Accordingly, the existing lock has a short latch, which is not able to meet the user's requirement. Some other locks, in order to accomplish the goal of providing better locking effect, have long latches and complex structure to overcome the uneven movement of the latches. It is known in that art that complex structure is the synonym of high cost. Thus, the locks in the market with great locking effect are extremely expensive.

To overcome the shortcomings, the present invention tends to provide an improved transmission assembly of a lock to mitigate and obviate the aforementioned problems.

SUMMARY OF THE INVENTION

The main objective of the invention is to provide an improved transmission assembly of a lock, which has a transmission rod movably received in the latch of the lock, a push plate pivotally connected with the latch and a disk rotatably mounted on the latch and being opposite to a pivot hole for the push plate. With such an arrangement, the latch is able to extend to an outermost position to have a great locking effect. When the latch is retracted, the push plate abuts the disk to allow the latch to retract inside the lock assembly smoothly.

Other objects, advantages and novel features of the invention will become more apparent from the following detailed description when taken in conjunction with the accompanying drawings.

BRIEF DESCRIPTION OF THE DRAWINGS

FIGS. 3A, 3B and 3C are schematic views showing the movement of the latch in correspondence to the rotational movement of a deadbolt assembly and.

DETAILED DESCRIPTION OF PREFERRED EMBODIMENT

Figure 1:
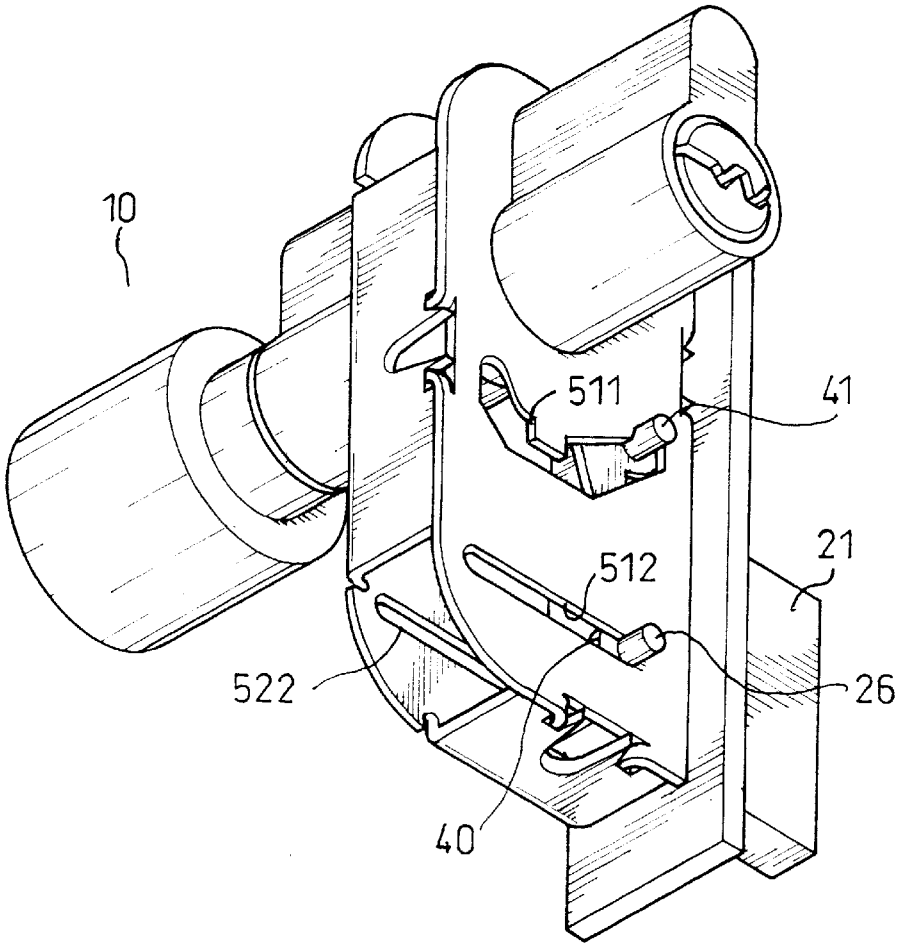
FIG. 1 is a perspective view of a lock assembly together with a transmission device in accordance with the present invention.
Figure 2:
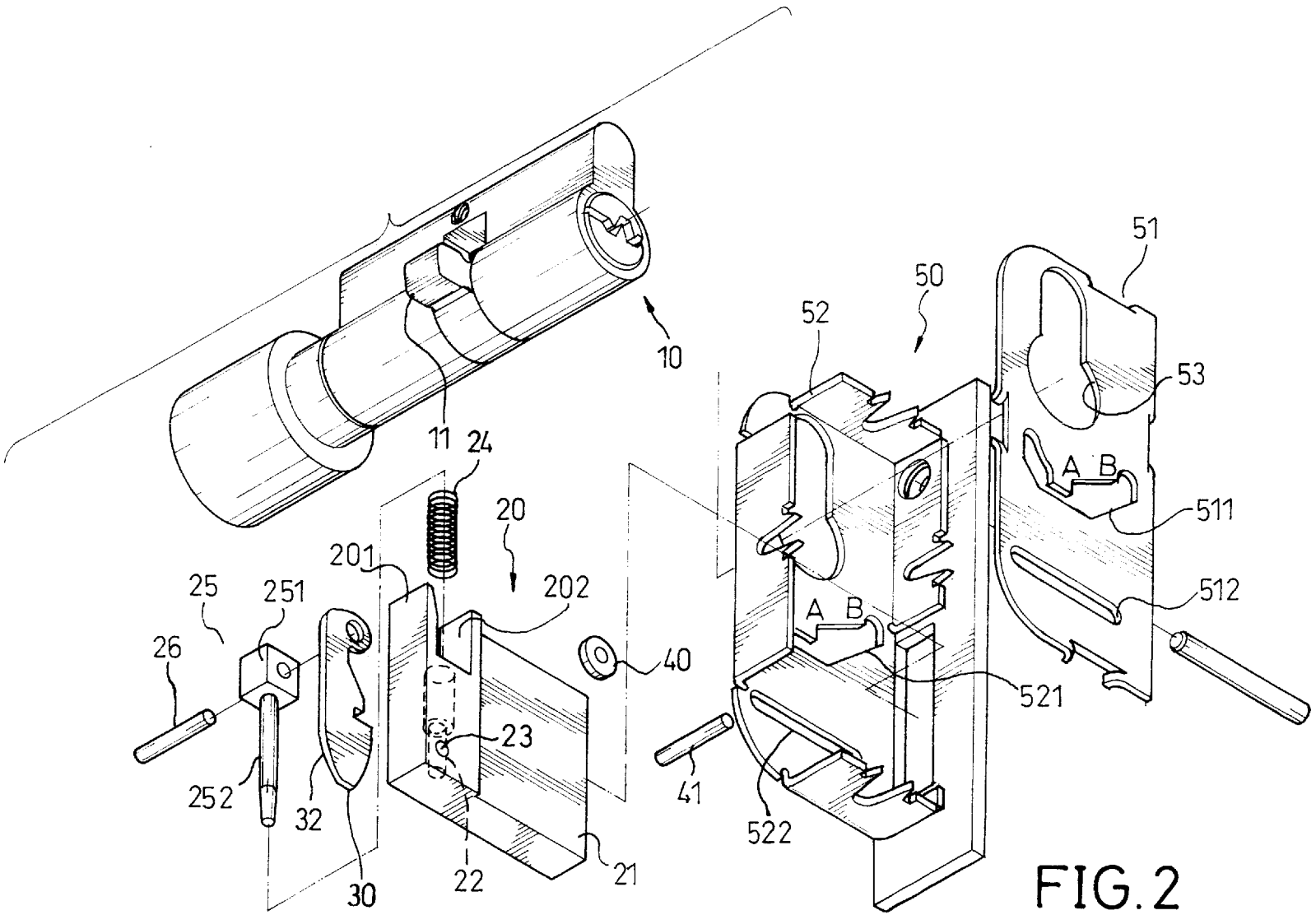
FIG. 2 is an exploded perspective view showing the components of the transmission device of the invention.

Referring to FIGS. 1 and 2, the transmission assembly in accordance with the present invention has a deadbolt assembly (10), a latch assembly (20), a push plate (30), a disk (40) and a casing (50).

The deadbolt assembly (10) forms thereon a boss (11) and is rotatably received in a keyhole (53) of the casing (50).

The latch assembly (20) has a latch (21) slidably received in the casing (50) and defining therein a channel (22) and an opening (23) defined to communicate with the channel (22), a coil spring (24) compressibly received in the channel (22), a push rod (25) movably received in the channel (22) and having a head (251) and a guiding rod (252) inserted through the coil spring (24) and into the channel (22) and a lock pin (26) inserted through the head (251) and the casing (50) to secure the latch assembly (20) within the casing (50).

The push plate (30) is pivotally engaged with a side face of the latch (21) by the lock pin (26) and has an inclined front end (31) and an inclined rear end (32).

The disk (40) is rotatably engaged with the latch (21) and connected with the inclined rear end (32).

The casing (50) includes a cover (51) and a base (52). The cover (51) together with the base (52) defines a space (not numbered) to accommodate the aforementioned components. The cover (51) has a first passage (511) and a first slit (512) and the base (52) has a second passage (521) aligned with the first passage (5 1 1) and a second slit (522) aligned with the first slit (512). The first passage (511) together with the second passage (521) forms a path (not numbered) to allow the lock pin (26) to move inside the path. The first slit (512) together with the second slit (522) defines a passageway (not numbered) to allow the movement of a guiding pin (41) which extends through the latch (21) from the opening (23) and engages with the disk (40).

The latch (21) further has two opposed ledges (201) and a cutout (202) defined between the two opposed ledges (201) to communicate with the channel (22), such that the coil spring (24) and the push rod (25) are able to be inserted into the channel (22) from the cutout (202) and the head (251) is able to be movably received inside the cutout (202).

When the transmission assembly of the invention is assembled, the coil spring (24) and the push rod (25) are inserted from the cutout (202) of the latch (21) and into the channel (22) of the latch (21) that is placed inside the casing (50) and then the lock pin (26) extends into the first passage (511), through the head (251) of the push rod (25) and again through the second passages (521) of the casing (50) to secure the push rod (25) together with the coil spring (24) inside the latch (21). After which, the guiding pin (41) extends into the first slit (512), through the opening (23) of the latch (21) and the disk (40) and again through the second slit (522) of the base (52) to rotatably secure the disk (40) to the latch (21). Thereafter, the deadbolt assembly (10) is pivotally received in the keyhole (53) and the boss (11) is received in the cutout (202), which completes the assembly of the transmission assembly with the deadbolt assembly (10).

Figure 3C:
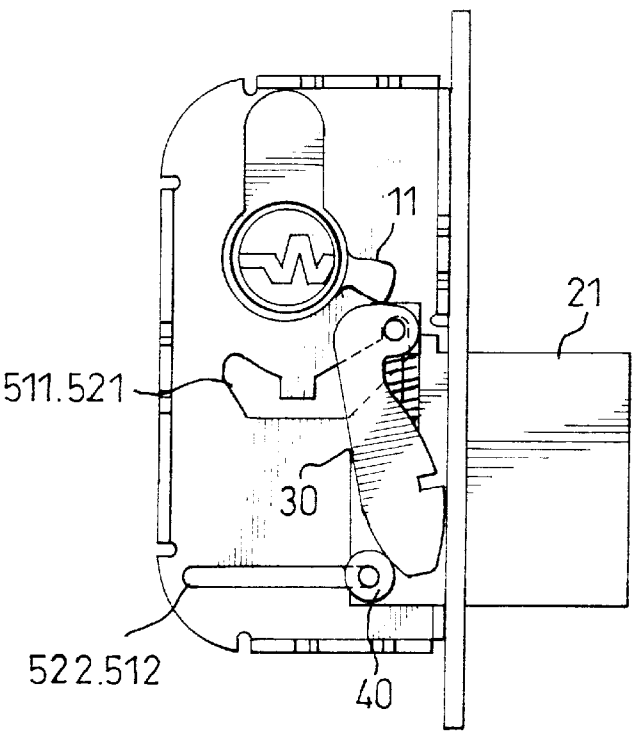
Figure 3B:
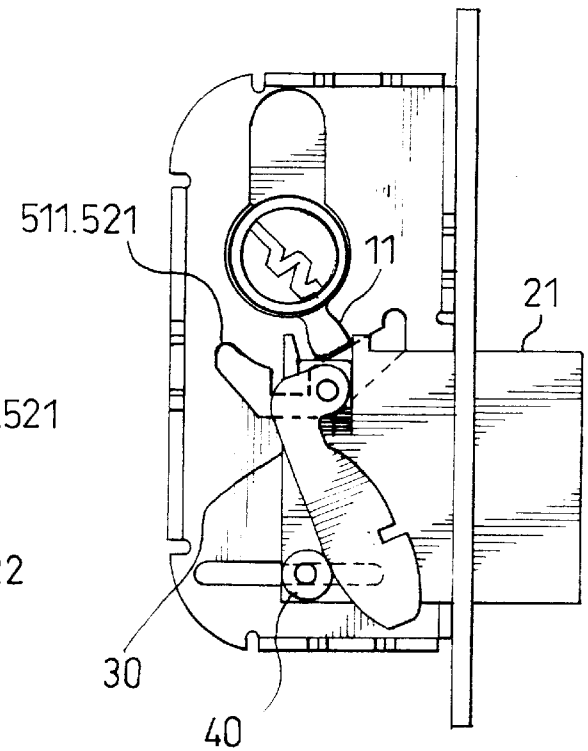
Figure 3A:
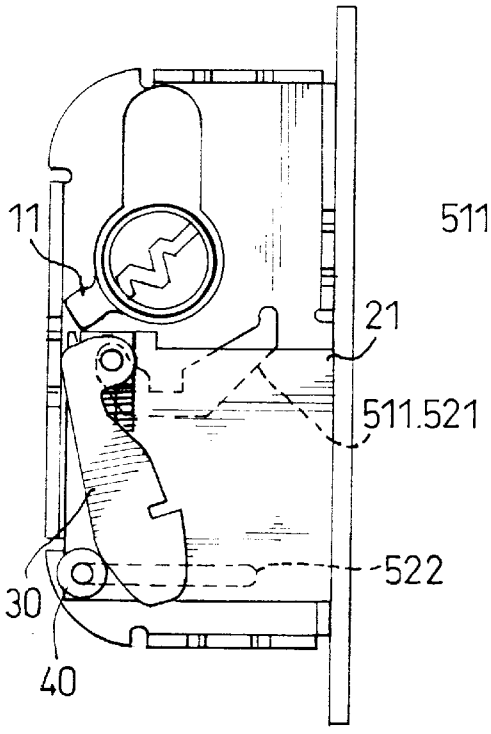

When the transmission assembly of the invention is in use, as shown in FIGS. 3A, 3B and 3C, the user rotates the deadbolt assembly (10) to allow the boss (11) to engage the head (251). The continuously rotational movement of the deadbolt assembly (10) will drive the boss (11) to press the head (251) of the push rod (25) toward the channel (22), which gradually allows the boss (11) to engage one of the ledges (201) and eventually pushes the latch (21).

It is noted from the drawings that the aligned first and second passages (511,521) are arcuate, such that when the lock pin (26) together with the latch (21) reaches a point A in the aligned first and second passages (511,521), the force of the coil spring (24) will push the head (251) upward in the cutout (202) and thus the boss (11) of the deadbolt assembly (10) is pushed to rotate further. The force of the coil spring (24) will then drive the latch (21) to extend further out of the casing (50) and the lock pin (26) will then reach the point B automatically, which completes the lock mode of the lock. While the lock pin (26) is moving along the aligned first and second passages (511,521), the guiding pin (41) is also moving along the aligned first and second slits (512,522). Due to the limitations of the aligned first and second passages (511,521) and the aligned first and second slits (512,522) to the lock pin (26) and to the guiding pin (41) respectively, the movement of the latch (21) is smooth inside the casing (50).

Figure 4A:
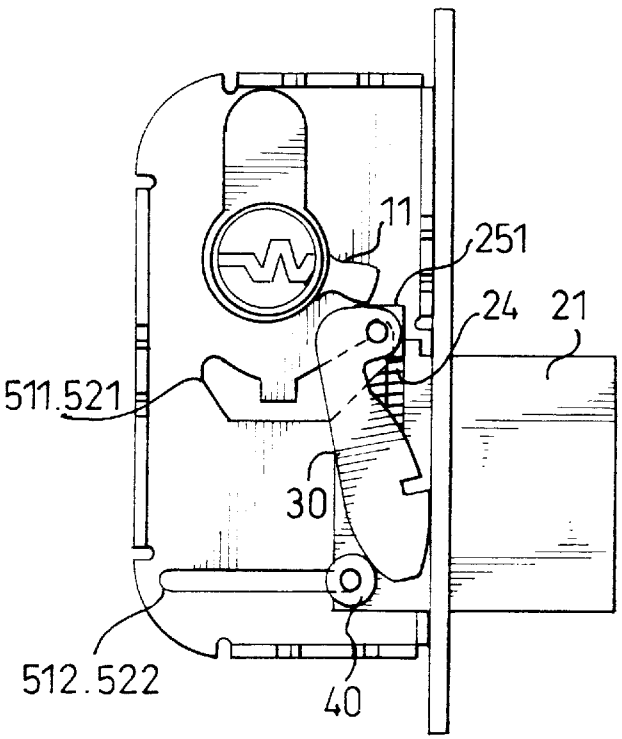
Figure 4B:
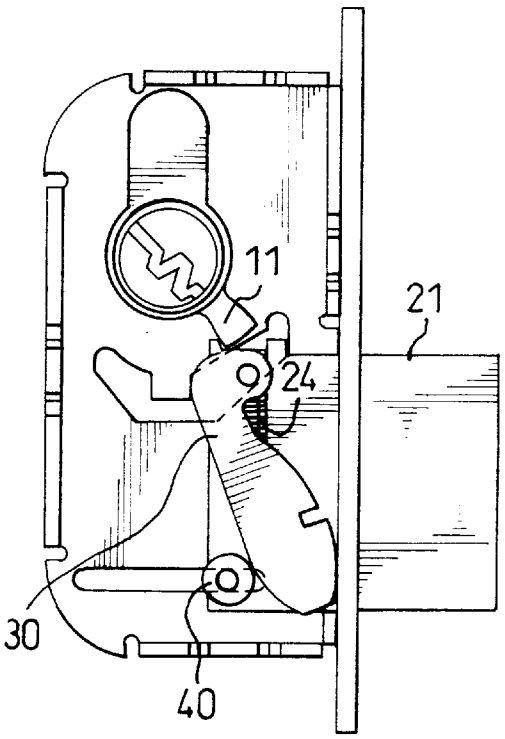
Figure 4C:
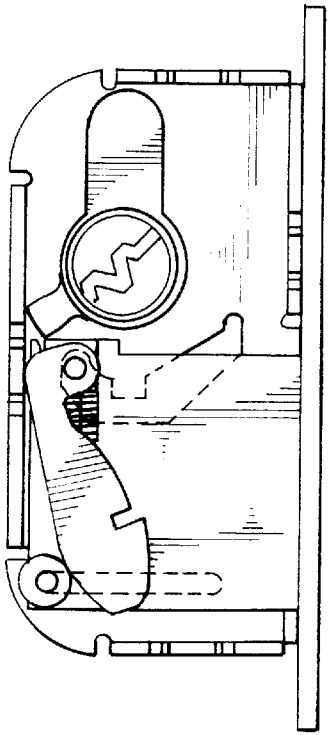

With reference to FIGS. 3C, 4A, 4B and 4C, when the lock is unlocking, the user rotates the deadbolt assembly (10), the boss (11) presses the head (251) to push the head (251) downward into the channel (22) of the latch (21), hence the boss (11) is able to engage the other ledge (201) of the latch (21) to drive the latch (21). At the initial movement of the latch (21), an uneven movement of the latch (21) will cause the latch (21) to be blocked inside the casing (50). In order to overcome the blockage of the latch (21) inside the casing (50), the downward and sideward movement of the latch (21) will cause the push plate (30) to pivot. While the push plate (30) pivots, the abutment of the inclined front end (31) to an inner face of the casing (50) and the engagement with the disk (40) will drive the latch (21) evenly move inward in the casing (50), especially shown in FIG. 4B. Once the latch (21) evenly moves inside the casing (50), the continuously rotational movement of the deadbolt assembly (10) will then move the latch to a point C in the aligned first and second passages (511,521). After the latch (21) reaches the point C, the force from the coil spring (24) will push the head (251) upward inside the channel (22), which will push the boss (11) of the deadbolt assembly (10) to rotate further to complete the unlock mode, as shown in FIG. 4C.

It is to be noted that in the conventional lock assembly, if the hole in the doorframe is jammed by a chewing gun, the latch can still extend into the hole, which leaves an impression to the user that the door is locked. However, once the door is pushed again, the latch will retract inside the casing and the door is opened. In the preferred embodiment of the invention, should the hole in the doorframe is jammed by a chewing gun and the latch of the invention extends to the hole, due to the head (251) being pressed by the boss (11) of the deadbolt assembly (10), so that even when the lock is not in a full lock mode, the latch (21) will not retract inside the casing (50) once the door is pushed again trying to reopen the door, which increases the safety of the user.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock comprising:

a casing having a cover with a first passage and a base with a second passage aligned with the first passage, wherein the cover and the base defines a space;

a deadbolt assembly pivotally received in the casing and having a bosses integrally formed with the deadbolt assembly;

a latch slidably received in the space of the casing and driven by the deadbolt assembly, the latch having a channel, a cutout communicating with the channel and two opposed ledges with the cutout defined therebetween, wherein each of the ledges respectively engages with the boss of the deadbolt assembly;

a push rod movably received in the latch and engaged with the deadbolt assembly;

a push plate pivotally engaged with the latch; and a disk mounted on a side face of the latch and rotatably engaged with a side face of the push plate.

2. The lock as claimed in claim 1, wherein the first and second passages of the cover and the base are arcuate, such that the latch is able to move spontaneously from a first position to a second position by means of a force coming from a coil spring received in the channel.

3. The lock as claimed in claim 2, wherein the push rod has a head received in the cutout and a guiding rod inserted through the coil spring to regulate the coil spring within the channel.

4. The lock as claimed in claim 3, wherein the push plate has an inclined front end and an inclined read face, the front end being abutted against an inner face of the casing when the latch is moving inside the casing and the read end being engaged with the disk.

5. The lock as claimed in claim 4, wherein the cover has a first slit and the base has a second slit aligned with the first slit, such that a guiding pin extending through the latch to secure the disk onto the latch is able to extend through the aligned first and second slits to regulate the movement of the latch inside the casing.

6. The lock as claimed in claim 4, wherein a lock pin extending through head of the push rod to secure the push rod inside the latch is able to extend through the aligned first and second passages to regulate the movement of the latch inside the casing.

7. The lock as claimed in claim 5, wherein a lock pin extending through the head of the push rod to secure the push rod inside the latch is able to extend through the aligned first and second passages to regulate the movement of the latch inside the casing.

* * * * *